US007377063B2

(12) United States Patent
Meyer

(10) Patent No.: US 7,377,063 B2
(45) Date of Patent: May 27, 2008

(54) SWITCHING HAND GESTURE DISPLAY DEVICE

(76) Inventor: Richard Meyer, 12715 Chandler Cir., Omaha, NE (US) 68138

( * ) Notice: Subject to any disclaimer, the term of this patent is extended or adjusted under 35 U.S.C. 154(b) by 184 days.

(21) Appl. No.: 11/440,871

(22) Filed: May 25, 2006

(65) Prior Publication Data

US 2006/0265918 A1 Nov. 30, 2006

Related U.S. Application Data

(60) Provisional application No. 60/684,397, filed on May 25, 2005.

(51) Int. Cl.
*G09F 21/04* (2006.01)

(52) U.S. Cl. ..... 40/591; 40/493; 116/43

(58) Field of Classification Search ..... 40/591, 40/613–614, 424–425, 483, 493, 497, 508, 40/531, 532, 533; 116/28 R, 43, 46–48, 116/51; 446/230, 231, 232
See application file for complete search history.

(56) References Cited

U.S. PATENT DOCUMENTS 1,252,059 A * 1/1918 Thiel ..... 116/51
1,302,130 A * 4/1919 Bower ..... 116/51
1,497,286 A * 6/1924 Acosta ..... 116/48
2,147,010 A * 2/1939 Cranford ..... 116/39
2,204,027 A * 6/1940 Peyton ..... 116/51

* cited by examiner

*Primary Examiner*—Cassandra Davis
(74) *Attorney, Agent, or Firm*—Stinson Morrison Hecker LLP; Adam H. Jacobs

(57) ABSTRACT

A switching gesture display device for vehicles includes a main box and a shaft rotatably mounted in the main box with opposite ends extending through and outside the main box, the shaft being rotatable between an initial position and a rotated position. Two primary indicia displays are mounted on the opposite ends of the shaft, the two primary indicia displays being displayed in a generally upright position when the shaft is in the initial position, and two secondary indicia displays are mounted on the shaft generally adjacent the two primary indicia displays, the two secondary indicia displays being displayed in a generally upright position when the shaft is in the rotated position. A shaft rotation device rotates the shaft between the initial position and the rotated position to alternatively display the two primary indicia displays in the initial position and the two secondary indicia displays in the rotated position.

16 Claims, 3 Drawing Sheets

SWITCHING HAND GESTURE DISPLAY DEVICE

CROSS-REFERENCE TO RELATED PROVISIONAL PATENT

This application claims priority based on a provisional patent, specifically on the Provisional Patent Application Ser. No. 60/684,397 filed May 25, 2005.

BACKGROUND OF THE INVENTION

1. Technical Field

A display device for selectively displaying a variety of different face and hand signals, gestures, or objects from the rear of a vehicle. The display device includes a main box that typically has an image of a face gesture with visible hands or objects. The display device is mounted in a fashion to be visible for other motorists behind such vehicle with display device. The display device is connected to some sort of power source and is provided with a control switch to allow the driver to activate the display device to reveal a second gesture, hand signal, or object.

2. Description of the Prior Art

Drivers of automobiles traveling down a road are able to see the invention from the rear of the vehicle. The vehicle displaying the invention can then use the remote feature or the installed type of power controller to display multiple gestures. These gestures typically resembling hands, along with the invention itself and the mentioned main box, will be visible and from the following automobile or visible to those within proximity. The owner of the mentioned invention may choose from a variety of display feature including but not limited to hand gestures.

It is an object of the invention to be able to display different hand gestures or to display the chosen object of the owner for view by other motorists. It is another object of the invention to be remotely controlled to produce changing gestures or objects of the owner's choice, and for the mechanics of the invention and power to be supplied to the invention for use of such display.

It is yet another object of the invention to provide a display device which is easily visible to other motorists. Accordingly, the display device is preferably mounted near or at the rear of the vehicle, facing outward.

It is a further object of the present invention to provide a device that allows users to selectively display a variety of different gestures, hand signals, or object of choice from the rear of their vehicles. Accordingly, the present invention discloses a display device that is securely mounted at or near the rear of the vehicle. The display device is connected to a power source provided by the vehicle, and has a switch selectively mounted by the owner of the invention providing the remote control feature of the display device.

To the accomplishment of the above and related objects the invention may be embodied in the form illustrated in the accompanying pictures. Attention is called to the fact, however, that the pictures are for informative purposes only. Variations are contemplated as being part of the invention.

SUMMARY OF THE INVENTION

The present invention provides a switching gesture display device for vehicles including a main box having outer walls and an interior volume and a shaft rotatably mounted in the main box with opposite ends extending through and outside of the outer walls of the main box, the shaft being rotatable between an initial position and a rotated position. Two primary indicia displays are mounted one each on the opposite ends of the shaft external of the outer walls of the main box and extending generally perpendicularly therefrom, the two primary indicia displays extending generally coplanar with each other and being displayed in a generally upright position when the shaft is in the initial position, and two secondary indicia displays are mounted one each on the opposite ends of the shaft external of the outer walls of the main box and extending generally perpendicularly therefrom generally adjacent the two primary indicia displays, the two secondary indicia displays extending generally coplanar with each other and being displayed in a generally upright position when the shaft is in the rotated position. A shaft rotation device such as a solenoid is mounted within the main box and operatively connected with the shaft for controlled rotation thereof between the initial position and the rotated position whereby the shaft is rotatable to alternatively display the two primary indicia displays in the initial position and the two secondary indicia displays in the rotated position. Finally, a control switch such as a button is operatively connected to the shaft rotation device for engaging and disengaging the shaft rotation device to rotate the shaft between the initial and the rotated positions.

The switching gesture display device for vehicles as thus described provides a substantial advantage over other display device found in the prior art. For example, the level of excitement and entertainment generated by "flipping" of the indicia between the primary and the secondary indicia displays greatly increases the pleasure of owning and operating the present invention, particularly when compared to the level of excitement and entertainment generated by standard window and bumper decals and stickers. Furthermore, because the operator controls when the primary and secondary indicia displays are displayed, he or she can react and interact with situations and persons by initiating rotation of the shaft to display the primary or secondary indicia displays. Such an option is not available with prior art display devices. Finally, because the present invention is easily mounted on and removed from the vehicle, a user can use the present invention in particular situations and for particular events, options which are not available in situations where prior art display devices are being used. It is therefore seen that the switching gesture display device for vehicles of the present invention provides a substantial improvement over those devices found in the prior art.

DESCRIPTION OF THE PREFERRED EMBODIMENT

Figure 1:
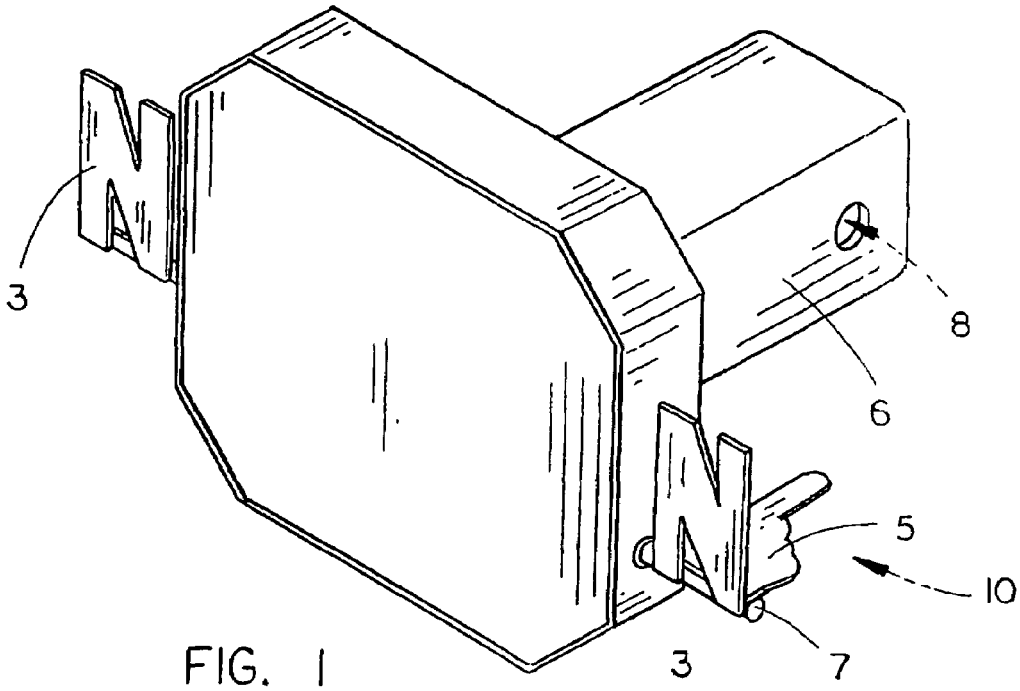
FIG. 1 is a perspective view of the switching gesture display device for vehicles of the present invention.
Figure 2:
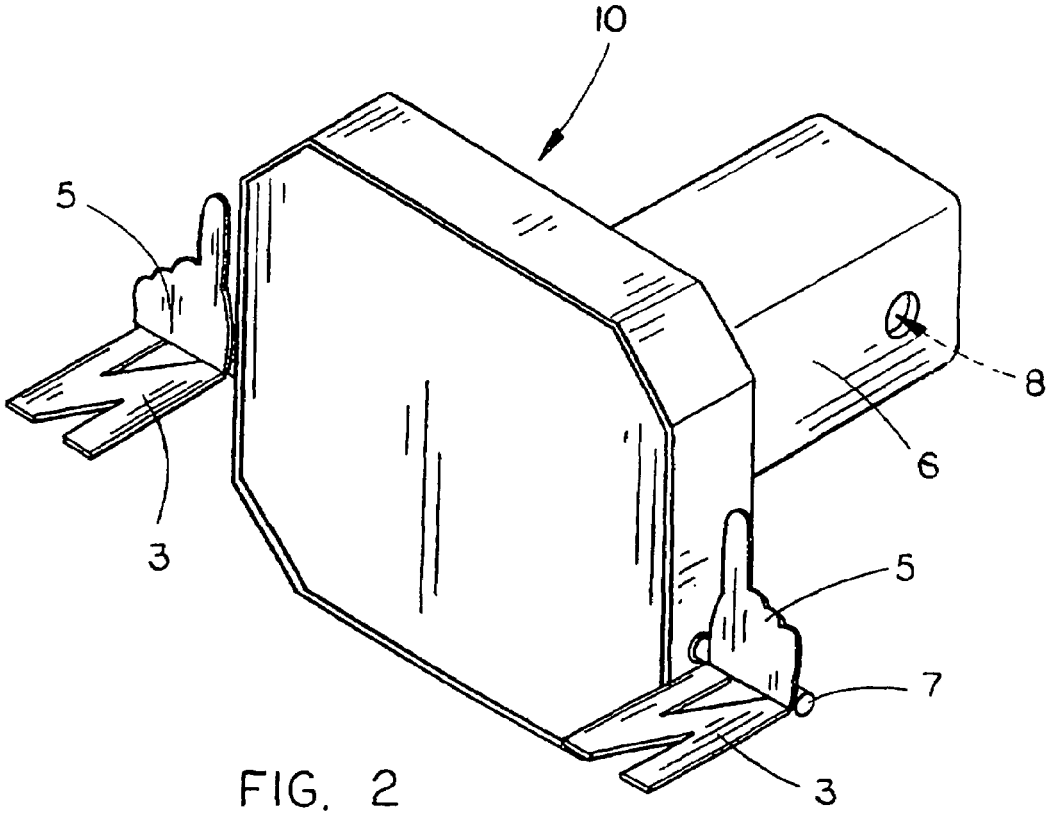
FIG. 2 is a perspective view of the switching gesture display device for vehicles of the present invention displaying the secondary indicia displays.
Figure 3:
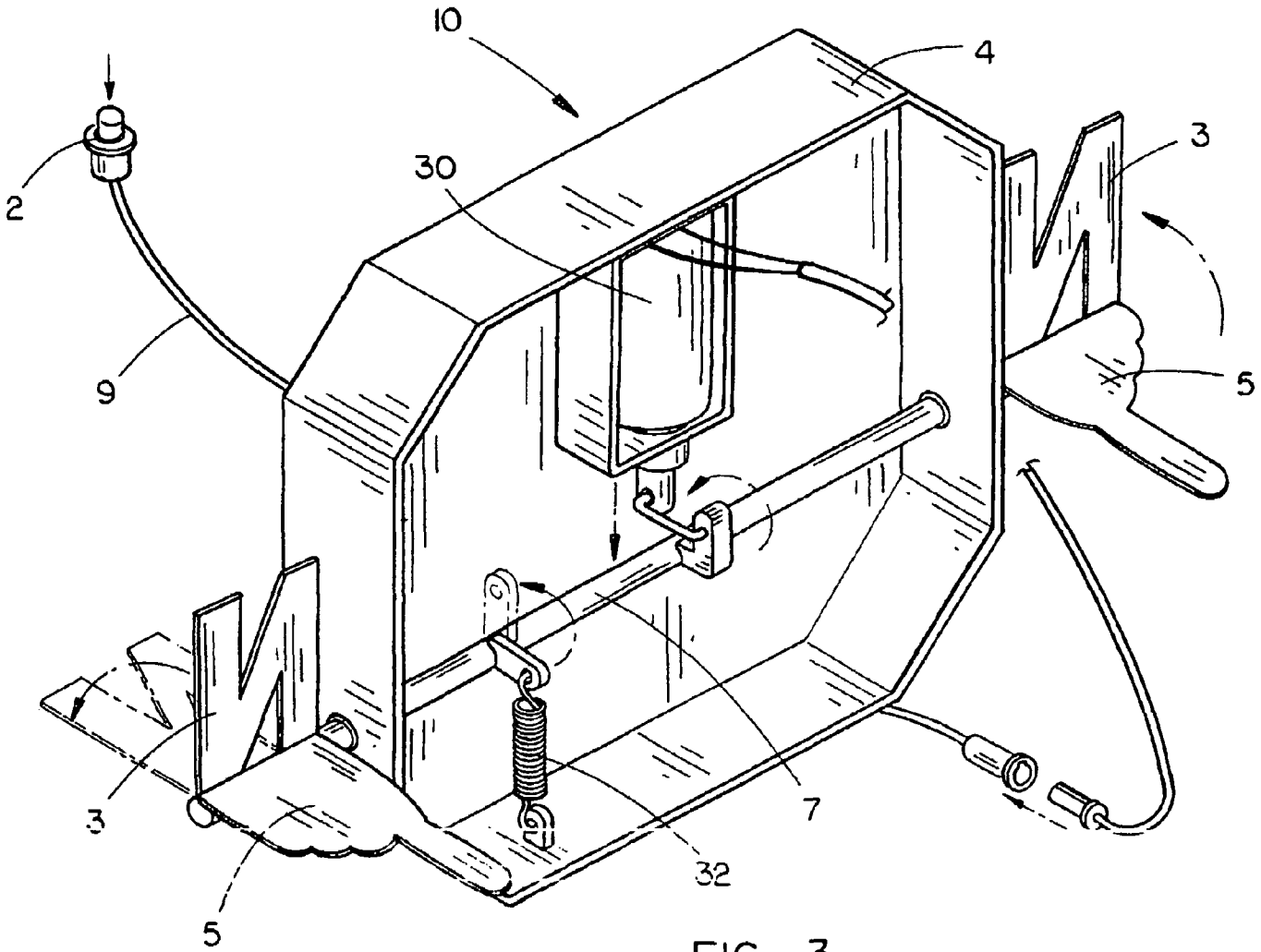
FIG. 3 is a detailed perspective view of the functional elements of the main box and how rotation of the shaft is accomplished.

FIGS. 1-3 show a display device 10 that is mounted at the rear of an automobile. The display device 10 is mounted at the rear of a vehicle, preferably on the hitch mount of the vehicle, in a manner which is visible to other vehicles.

According to the invention, it is possible to selectively adjust the display device 10 so that it displays the desired hands, gestures, or objects. As shown in FIG. 1, the display device 10 comprises a main box 4. According to the present invention, the user may be provided with a variety of primary indicia displays 3, which in the preferred embodiment would be constructed of a sturdy sheet material such as sheet metal or plastic, be approximately 1" to 2" in height, and would have a different gesture or picture inscribed or formed thereon, such as the logo of a selected sports team or a hand gesture such as the index finger extended upwards in the widely recognized symbol for "# 1". These are mounted on and extend perpendicularly from a rotatable shaft 7 which extends through the main box 4, the operation of which will be described later herein. The hand or selected object are of a configuration as to be reasonably recognizable by motorists or persons located a safe distance away from and behind the vehicle equipped with the present invention.

The display device 10 is provided with a square tubing 6, shown in FIGS. 1 and 2, for mounting the display device 10 to a vehicle's trailer hitch receiver. Typically, the display device 10 would be mounted in the trailer receiver hitch of the vehicle, facing rearwards, although many different mounting systems and devices may be used with the present invention which will accomplish the intended purpose of mounting the device on the vehicle, such as a mounting bracket (not shown) or the like, and the use of such alternative mounting devices would be understood by one skilled in the art of mounting accessories to vehicles. Near the end of the square tubing 6, an opening 8 is provided to accommodate a holding pin (not shown) used to secure the invention to the hitch mount of the vehicle.

According to FIGS. 1 and 2, the display device 10 is shown revealing the secondary set of indicia, in this case the hand signal displays 5. The hand signal displays 5 show the extended index finger of the # 1 gesture and are illustrative of what will typically be displayed. Of course, it should be noted that many different types of alternate objects, indicia and gestures can and will be substituted for the hand signal displays 5 as presently described, and these, to a large extent, will be determined by the marketers and end users of the present invention. These secondary hand signal displays 5 are revealed by rotating the shaft 7 which, as was stated previously, runs through and extends outside of the main box 4. The secondary hand signal displays 5 (as shown in FIGS. 1-3) are mounted on opposite ends of the rotatably mounted shaft 7 external of the main box 4 and in such a fashion that the secondary hand signal displays 5 appear hidden when the primary indicia displays 3 are being shown as in FIGS. 1 and 3, and appear in the upright display position when the rotatable shaft 7 is rotated. The primary indicia displays 3 extend generally horizontal and thus are "edge-on" to the viewer of the present invention, and therefore when the secondary hand signal displays 5 are being displayed, the primary indicia displays 3 are generally not viewable.

The rotation of the shaft 7 is accomplished in the preferred embodiment by a solenoid 30 located in the interior of the main box 4, as shown in FIG. 3. The solenoid 30 preferably is of a standard type and is operatively connected to the rotating shaft 7 such that engagement of the solenoid 30 rotates the shaft 90°, and keeps the shaft in the rotated position until the solenoid 30 is disengaged. When the solenoid 30 is disengaged, the return spring 32 rotates the shaft in the opposite direction to return the shaft to its original position. Of course, other mechanisms may be provided for shaft rotation in substitution of the solenoid 30 and return spring 32, but it has been found that the above-described devices provide a simple yet functional solution to the intention of rotating the shaft 7.

As shown in FIG. 3, the main box 4 is provided with a control and power wire 9, wherein the wire 9 is connected to a power source of the vehicle for powering the solenoid 30. The wire 9 also encompass a control switch 2, wherein the control switch 2 allows the driver to activate the solenoid 30 selectively displaying the primary indicia displays 3 when the solenoid 30 is not engaged, thus leaving the shaft 7 in its initial position, as shown in FIG. 1, and the secondary hand signal displays 5 when the solenoid 30 is engaged, thus rotating the shaft 7 into its rotated position, as shown in FIG. 2. The typical power source is the vehicle's 12 volt cigarette lighter socket or extra power socket of the same nature. In the preferred embodiment, the invention will further include a standard 12 volt plug on the end of wire 9 which is insertable into the power socket, and such power connections are well-known in the prior art.

Figure 4:
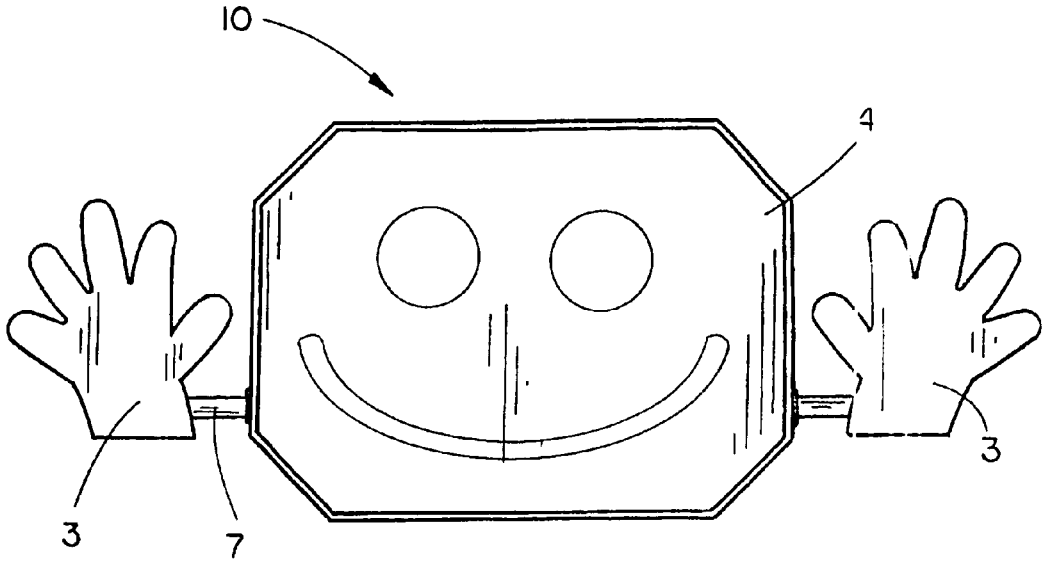
FIGS. 4 and 5 are front elevational views of an alternative design for the present invention.
Figure 5:
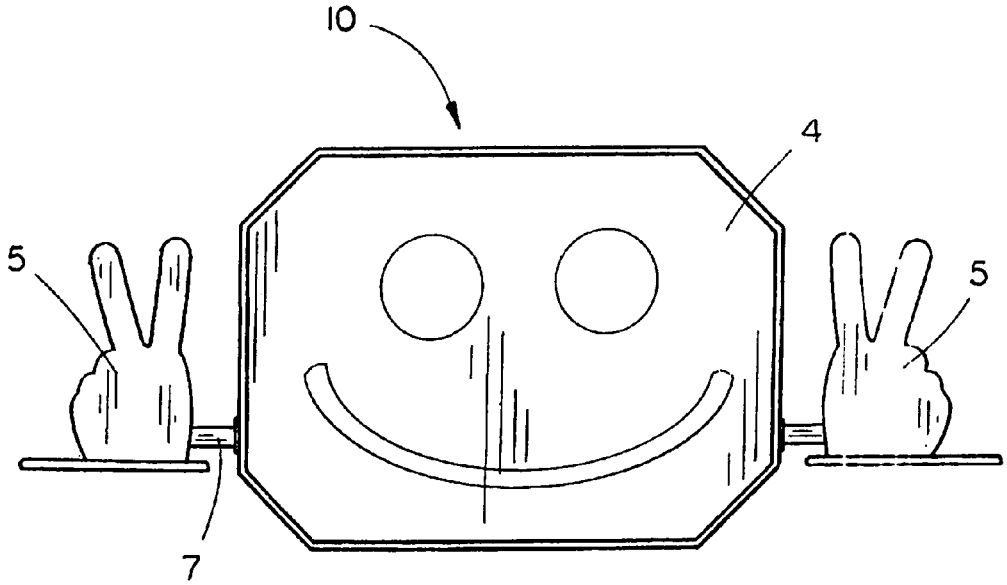

FIGS. 4 and 5 disclose an alternative embodiment of the present invention in which the primary indicia displays 3 and the secondary hand signal displays 5 are different from the embodiment of FIGS. 1-3. These figures are includes to provide some indication of the variety of displays that may be used with the present invention.

In summary, herein is disclosed a display device 10 that is provided with a primary desired hand, gesture or object that has the ability to reveal a secondary or "hidden" desired hand, gesture, or object mounted thereon. The main box is typically secured to the rear vehicle in some fashion either using the provided square tubing or some other securing fashion. The display device is connected to a power source of the vehicle and is provided with a control switch to allow the driver to activate the changing of the hand, gesture, or object. Many specific details contained in the above description merely illustrate some preferred embodiments and should not be construed as a limitation on the scope of the invention. Accordingly, many other variations are possible within the spirit of the present invention.

It is to be understood that numerous additions, modifications and substitutions may be made to the display device 10 of the present invention which fall within the intended broad scope of the appended claims. For example, the size, shape and construction materials used in connection with the various elements of the present invention may be modified or changed so long as the intended functional features of those elements are maintained. Furthermore, although the primary indicia displays 3 and the secondary hand signal displays 5 of the present invention have been described with some particularity, it should be noted that virtually any kind of indicia or display may be used with the present invention so long as the user of the present invention desires to display such indicia or design. Finally, the precise nature of the mechanism for rotation of the shaft 7 may be modified or changed so long as the rotational mechanism performs its intended function of rotating the shaft 7 when the mechanism is engaged.

There has therefore been shown and described a switching hand gesture display device 10 which accomplishes at least all of its intended objectives.

I claim:

1. A switching gesture display device for vehicles comprising:

a main box having outer walls and an interior volume;

a shaft rotatably mounted in said main box with opposite ends extending through and outside of said outer walls of said main box, said shaft being rotatable between an initial position and a rotated position;

at least two primary indicia displays each mounted on said opposite ends of said shaft external of said outer walls of said main box and extending generally perpendicularly therefrom, said at least two primary indicia displays extending generally coplanar with each other and being displayed when said shaft is in said initial position;

at least two secondary indicia displays each mounted on said opposite ends of said shaft external of said outer walls of said main box and extending generally perpendicularly therefrom generally adjacent said at least two primary indicia displays, said at least two secondary indicia displays extending generally coplanar with each other and being displayed when said shaft is in said rotated position; and shaft rotation means mounted within said main box and operatively connected with said shaft for controlled rotation thereof between said initial position and said rotated position whereby said shaft is rotatable to alternatively display said at least two primary indicia displays in said initial position and said at least two secondary indicia displays in said rotated position.

2. The switching gesture display device for vehicles of claim 1 further comprising vehicle mounting means mounted on said main box for mounting said main box on a vehicle.

3. The switching gesture display device for vehicles of claim 1 further comprising control means operatively connected to said shaft rotation means for engaging and disengaging said shaft rotation means to rotate said shaft between said initial and said rotated positions thereby alternately displaying said at least two primary indicia displays in said initial position and said at least two secondary indicia displays in said rotated position.

4. The switching gesture display device for vehicles of claim 1 wherein said at least two primary indicia displays and said at least two secondary indicia displays each are constructed of a generally rigid sheet material.

5. The switching gesture display device for vehicles of claim 1 wherein said shaft rotation means comprises a solenoid operatively connected to said shaft such that when said solenoid is engaged, said shaft is rotated from said initial position to said rotated position.

6. The switching gesture display device for vehicles of claim 1 further comprising a power cord connected to said shaft rotation means for connection to a power supply whereby power may be supplied to said shaft rotation means.

7. The switching gesture display device for vehicles of claim 1 further comprising a return spring operatively connected to said shaft for rotating said shaft from said rotated position to said initial position upon said shaft rotation means being disengaged.

8. The switching gesture display device for vehicles of claim 1 wherein said main box further comprises indicia displayed on said outer walls thereof in display image coordination with said two primary indicia displays and said two secondary indicia displays.

9. A switching gesture display device for vehicles comprising:

a main box having outer walls and an interior volume;

a shaft rotatably mounted in said main box with opposite ends extending through and outside of said outer walls of said main box, said shaft being rotatable between an initial position and a rotated position;

two primary indicia displays, one mounted on each of said opposite ends of said shaft external of said outer walls of said main box and extending generally perpendicularly therefrom, said two primary indicia displays extending generally coplanar with each other and being displayed in a generally upright position when said shaft is in said initial position;

two secondary indicia displays, one mounted on each of said opposite ends of said shaft external of said outer walls of said main box and extending generally perpendicularly therefrom generally adjacent said two primary indicia displays, said two secondary indicia displays extending generally coplanar with each other and being displayed in a generally upright position when said shaft is in said rotated position;

shaft rotation means mounted within said main box and operatively connected with said shaft for controlled rotation thereof between said initial position and said rotated position whereby said shaft is rotatable to alternatively display said two primary indicia displays in said initial position and said two secondary indicia displays in said rotated position; and control means operatively connected to said shaft rotation means for engaging and disengaging said shaft rotation means to rotate said shaft between said initial and said rotated positions.

10. The switching gesture display device for vehicles of claim 9 further comprising vehicle mounting means mounted on said main box for mounting said main box on a vehicle.

11. The switching gesture display device for vehicles of claim 9 wherein said at least two primary indicia displays and said at least two secondary indicia displays each are constructed of a generally rigid sheet material.

12. The switching gesture display device for vehicles of claim 9 wherein said shaft rotation means comprises a solenoid operatively connected to said shaft such that when said solenoid is engaged, said shaft is rotated from said initial position to said rotated position.

13. The switching gesture display device for vehicles of claim 9 further comprising a return spring operatively connected to said shaft for rotating said shaft from said rotated position to said initial position upon said shaft rotation means being disengaged.

14. The switching gesture display device for vehicles of claim 9 further comprising a power cord connected to said shaft rotation means for connection to a power supply whereby power may be supplied to said shaft rotation means.

15. The switching gesture display device for vehicles of claim 9 wherein said main box further comprises indicia displayed on said outer walls thereof in display image coordination with said two primary indicia displays and said two secondary indicia displays.

16. A switching gesture display device for vehicles comprising:

a main box having outer walls and an interior volume;

indicia display movement means mounted within said main box and extending through said outer walls;

two primary indicia displays each mounted on said indicia display movement means external of said outer walls of said main box and extending generally outwards therefrom, said two primary indicia displays extending generally coplanar with each other;

two secondary indicia displays each mounted on said indicia display movement means external of said outer walls of said main box and extending generally outwards therefrom generally adjacent said two primary indicia displays, said two secondary indicia displays extending generally coplanar with each other and; and said indicia display movement means operative to move said two primary indicia displays and said two secondary indicia displays between an initial position in which said two primary indicia displays are displayed and a rotated position in which said two secondary indicia displays are displayed thereby alternatively displaying said two primary indicia displays and said two secondary indicia displays.

* * * * *